9/9/86 XR 4,610,161

United States Patent [19]

Gehrig et al.

[11] Patent Number: 4,610,161

[45] Date of Patent: Sep. 9, 1986

[54] METHOD AND APPARATUS FOR DETERMINING FLUID CIRCULATION CONDITIONS IN WELL DRILLING OPERATIONS

[75] Inventors: George F. Gehrig; Jerry M. Speers, both of Houston, Tex.

[73] Assignee: Exxon Production Research Co., Houston, Tex.

[21] Appl. No.: 751,930

[22] Filed: Jul. 5, 1985

[51] Int. Cl.[4] ..... E21B 47/10

[52] U.S. Cl. ..... 73/155; 175/48; 175/7

[58] Field of Search ..... 73/151, 151.5, 155, 73/153, 196; 175/5, 7, 48; 364/510

[56] References Cited

U.S. PATENT DOCUMENTS

| | | | |
|---|---|---|---|
| 3,602,322 | 8/1971 | Gorsuch | 175/48 |
| 3,760,891 | 9/1973 | Gadbois | 175/48 |
| 3,809,170 | 5/1974 | Ilfrey et al. | 175/7 |
| 3,811,322 | 5/1974 | Swenson | 73/155 |
| 3,910,110 | 10/1975 | Jefferies et al. | 73/155 |
| 3,946,211 | 3/1976 | Jenkins, Jr. | 235/151.1 |
| 3,976,148 | 8/1976 | Maus et al. | 175/7 |
| 4,135,841 | 1/1979 | Watkins | 405/196 |
| 4,282,939 | 8/1981 | Maus et al. | 175/7 |
| 4,440,239 | 4/1984 | Evans | 175/5 |
| 4,553,429 | 11/1985 | Evans et al. | 73/155 |

*Primary Examiner*—Stephen A. Kreitman
*Assistant Examiner*—Scott M. Oldham
*Attorney, Agent, or Firm*—Richard F. Phillips

[57] ABSTRACT

A method and apparatus for establishing the rate at which fluid is transferred between an offshore well 16 and the formations 20 surrounding the well 16 in the course of drilling the well 16 from a floating drilling rig 14. A drilling fluid handling system 31 is used to inject drilling fluid into the well 16. A marine riser 22 extending from the sea bottom 18 to the rig 14 is provided to return the drilling fluid to the rig 14. The riser 22 is provided with a slip joint 26 to accommodate wave induced heave of the rig 14. Inflow and outflow flowmeters 42,44 are provided to monitor the rates at which drilling fluid is injected into the well 16 and returned to the rig 14. The return flow rate signal is filtered to mitigate the cyclical variations resulting from extension and contraction of the slip joint 26. A signal processing system 46 is provided to maintain the time constant applied in the filtering process at an optimum level as the rate and magnitude of rig heave varies with time. The input and filtered output signals are combined to yield a differential flow signal which is compared to a preselected alarm limit to determine if excessive fluid transfer between the well 16 and surrounding formations 20 is occurring.

22 Claims, 4 Drawing Figures

FOR TC = 90 SECONDS $T = \frac{TC}{14/2} = 12.9$ SEC.

$F = A - B$

METHOD AND APPARATUS FOR DETERMINING FLUID CIRCULATION CONDITIONS IN WELL DRILLING OPERATIONS

FIELD OF THE INVENTION

This invention relates generally to a method and apparatus useful in monitoring the circulation of fluid in a subterranean well. More particularly, this invention concerns a method and apparatus for continuously monitoring drilling fluid circulation to detect kicks and lost circulation occurring in the course of offshore drilling operations conducted from a floating drilling platform or vessel.

BACKGROUND OF THE INVENTION

One of the most important and sensitive aspects of well drilling operations involves controlling the rate of fluid transfer between the well and the various subterranean rock formations surrounding the borehole. Control of this fluid transfer is achieved by varying the properties of the fluid, termed "drilling fluid" or "drilling mud", which is circulated through the well in the course of drilling operations. The drilling fluid serves several purposes in addition to its use in controlling fluid transfer between the rock formations and the borehole, including: cooling and lubricating the drill bit, carrying rock cuttings away from the bottom of the borehole, and supporting the walls of the borehole. Typically, the drilling fluid is injected into the bottom portion of the borehole through the tubular drill string used to drill the well. The drilling fluid returns to surface through the annular portion of the borehole external to the drill string.

As the drill bit penetrates a subterranean formation, that formation is brought into fluid communication with the surface via the borehole. If the pressure of a permeable formation traversed by the borehole exceeds that of the borehole by a sufficient amount, the fluids in the formation (typically water, oil or hydrocarbon gas) can be forced into the borehole under pressure and released to the surface in an uncontrolled manner. This condition is commonly known as a blowout. To prevent blowouts, the density of the drilling fluid is carefully controlled to maintain the pressure in the borehole at a level such that the fluids in permeable formations are prevented from entering the borehole.

Well control problems can also arise if the pressure in the borehole significantly exceeds that of one or more of the formations traversed by the borehole. Should the density of the drilling fluid be greater than that of a permeable formation, it is possible for drilling fluid to be forced into the formation. This condition is termed "lost returns". In some instances the hydrostatic pressure of the drilling fluid can be great enough to fracture a weak formation, causing drilling fluid to pass into the formation at a rapid rate. As an additional complication, should there also be a relatively high pressure formation at another point along the borehole, this loss of drilling fluid to the weak formation can cause a temporary drop in the hydrostatic pressure head of the borehole of sufficient magnitude to induce a blowout from the high pressure formation. To minimize the potential for lost returns, it is usually necessary to control the density of the drilling fluid so that the pressure in the borehole does not greatly exceed that of the weak formations and permeable formations.

The most effective manner of guarding against blowouts is to monitor the well to determine the onset of formation fluid intrusion. If this initial intrusion, commonly referred to as a "kick", is detected at its inception, it is usually not difficult to prevent the situation from advancing to a blowout. Similarly, lost circulation is most easily corrected when the loss of drilling fluid is detected at an early stage.

One of the most common techniques for detecting kicks and lost circulation in the course of drilling operations is delta flow monitoring. Delta flow monitoring involves comparing the rate at which drilling fluid is injected into the well to the rate at which drilling fluid exits the well. After monitoring these rates over a sufficient period of time, it becomes possible to determine the differential ("delta") flow rate. The delta flow rate represents the cumulative change in the amount of drilling fluid within the well over the selected time period. A net addition of drilling fluid to the borehole is indicative of lost returns. Likewise, an excess of returned drilling fluid over injected drilling fluid signals the intrusion of formation fluids, possibly the onset of a blowout. Upon receipt of an indication of such well control problems, remedial measures must be initiated. These remedial measures are usually designed to lessen the pressure differential between the borehole and the surrounding formations, or to seal the permeable formations through which fluid migration is occurring.

Delta flow monitoring poses special difficulties in offshore drilling operations conducted from a floating drilling platform, such as a drillship. Floating drilling operations must accommodate wave-induced motion of the drilling rig relative to the borehole. To accommodate this motion, the marine riser, which serves to extend the borehole from the seafloor to the drillship, is provided with a telescoping slip joint. As vessel motion causes the slip joint to expand and contract, the fluid capacity of the return flowpath for the drilling fluid changes. This introduces nonuniform, cyclical variations in the rate of drilling fluid outflow. These variations mask the true delta flow.

Numerous attempts have been made to develop techniques and apparatus for mitigating or eliminating the effects of vessel heave on delta flow monitoring. One class of such developments involves placing the drilling fluid return flowmeter below rather than above the slip joint. One such system is disclosed in U.S. Pat. No. 3,811,322, issued May 21, 1974. While such systems avoid the effects of vessel heave, they are disadvantageous in that they require that a flow measurement be made of the drilling fluid passing through the annulus defined by a rotating drill string and the non-rotating riser. Obtaining accurate flow measurements over all flow conditions with this arrangement presents numerous mechanical problems. Further, positioning the drilling fluid return flowmeter beneath the slip joint places it in a relatively inaccessible location, rendering repair or replacement difficult should the meter fail.

A second system for eliminating the effects of vessel heave on delta flow measurements involves correcting the rate at which drilling fluid passes through the output flowmeter so that it does not detect the instantaneous component of fluid flow resulting from vessel heave. U.S. Pat. No. 4,135,841, issued Jan. 23, 1979, discloses a heave compensator which causes a change in the fluid volume of the drilling fluid return line equal and opposite to the change caused by motion of the slip joint. Use of this heave compensator substantially eliminates the effect of vessel heave on the flow rate, but is disadvantageous in that it requires complicated and bulky mechanical equipment.

A third system for eliminating the effects of vessel heave involves processing the output signal of the drilling fluid return flowmeter to mitigate the cyclical contribution of slip joint volume change. In one such system, taught in U.S. Pat. No. 4,282,939, issued Aug. 11, 1981, the delta flow measurement is averaged over a time period extending from when the slip joint is in a given reference position until the vessel goes through one complete heave cycle, returning to that reference position. In this manner, flow rate fluctuations due to vessel heave are substantially eliminated. A disadvantage of this system is that a sensor is required on the slip joint. This complicates installation and maintenance of the delta flow system. Further, averaging the delta flow over only a single vessel heave cycle yields an averaging period too short to adequately diminish cyclical variations in delta flow resulting from causes other than vessel heave, such as vessel pitch and yaw. Another such system, disclosed in U.S. Pat. No. 4,440,239, issued Apr. 3, 1984, utilizes an output signal filter having a long and a short time constant selectively applied in response to the magnitude of vessel heave. This system is disadvantageous in that in many instances the applied filtering is too severe, causing excessive lag in the response of the delta flow monitoring system. Excessive filtering desensitizes the monitoring system, introducing an unduly great lag time between the onset of the well fluid control problem and detection of the problem. Conversely, too little filtering can result in false alarms, resulting from wave induced flowrate oscillations being incorrectly detected as a well control problem.

SUMMARY OF THE INVENTION

A method and apparatus are set forth which are useful in monitoring drilling fluid circulation conditions in well drilling operations. The present invention is especially well suited for use on a drillship and in other offshore drilling operations in which the drilling rig moves up and down relative to the wellhead as the result of wave-induced vessel heave. The drilling fluid handling system is provided with flowmeters for measuring the rate at which drilling fluid is injected into and returned from the well. The measured flow rates are processed with a variable filter. The degree of filtering applied at a given instant is a function of the rate of vessel heave and the magnitude of the oscillations in the rate of drilling fluid return. The degree of filtering is continually updated by the system. After being filtered, the flow rates are summed to yield a differential flow rate, which represents the rate at which drilling fluid is gained or lost. The continual automatic adjustment of the filter optimizes the balance between decreasing filter-induced lag in detecting a drilling fluid circulation abnormality and avoiding false warnings regarding such circulation abnormalities. This optimized balance is maintained over a range of environmental and operational conditions. The present invention also incorporates means to accommodate apparent flow rate changes resulting from drilling string motion, changes to the rate at which drilling fluid is pumped into the well, and pitch and roll of the vessel.

BRIEF DESCRIPTION OF THE DRAWINGS

For a better understanding of the present invention, reference may be had to the accompanying drawings, in which.

These drawings are not intended as a definition of the invention, but are provided solely for the purpose of illustrating certain preferred embodiments of the invention as described below.

DESCRIPTION OF THE PREFERRED EMBODIMENTS

Figure 1:
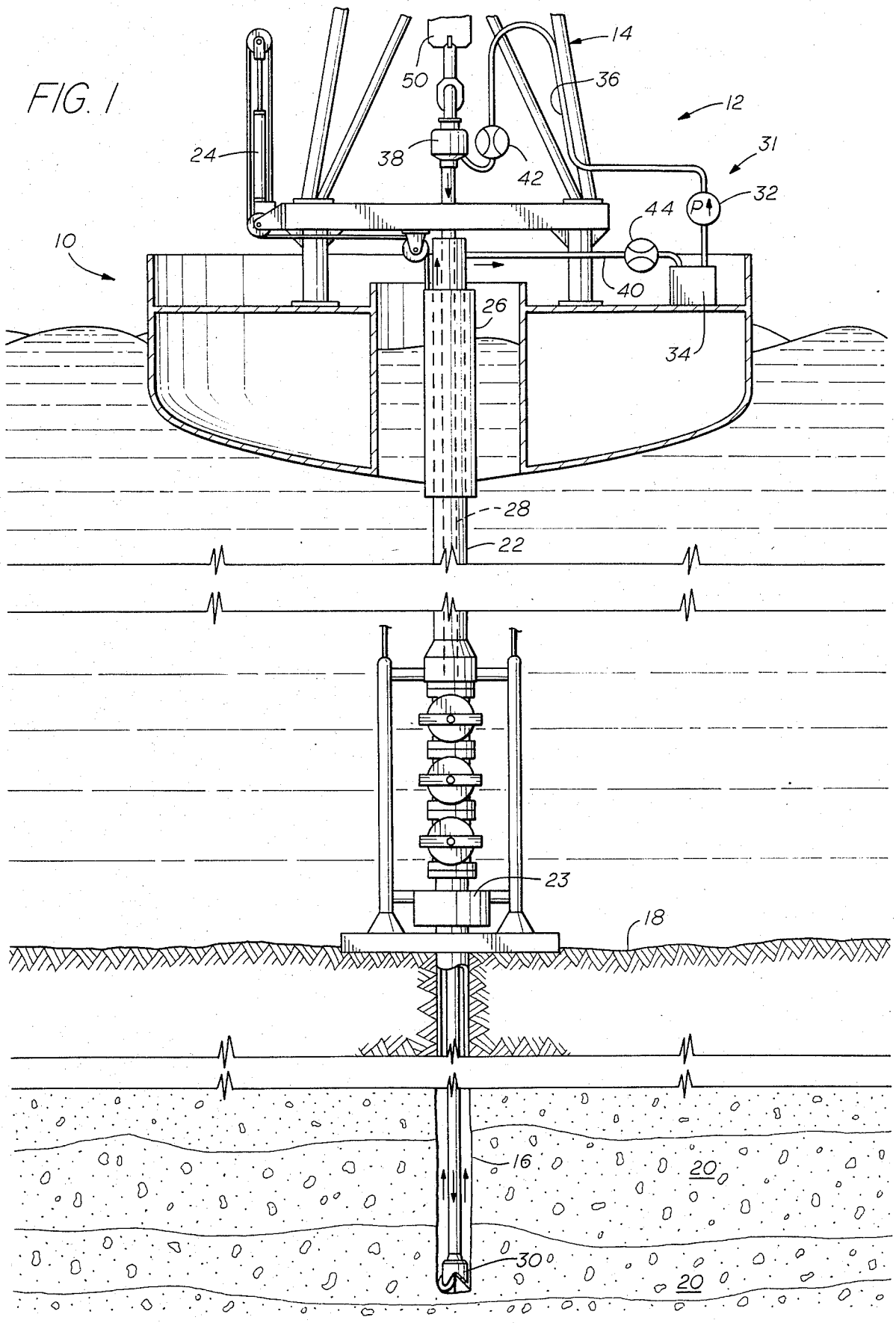
FIG. 1 shows an elevational cross section, partly in schematic, of a drillship incorporating an embodiment of the present invention.

Illustrated in FIG. 1 is a drill ship 10 incorporating the mechanical components of a preferred embodiment of the delta flow monitoring system 12 of the present invention. As will become apparent in view of the subsequent discussion, the preferred embodiment of this invention is especially well suited for minimizing the effects of vessel heave on delta flow measurements made in the course of drilling operations conducted from a floating drilling platform or vessel. However, other embodiments of the present invention may be used to advantage in drilling operations conducted on land or from a fixed offshore platform, where motion of the drilling rig relative to the well does not occur. To the extent that the embodiment described below is specific to drilling operations conducted from floating drilling rigs subject to significant wave action, this is by way of illustration rather than limitation.

As shown in FIG. 1, the drill ship 10 supports a drilling rig 14 which is used to drill a well 16 extending downward from the sea bottom 18 through a plurality of subterranean formations 20. A marine riser 22 extends upward to the drillship 10 from a wellhead 23 situated at the sea bottom 18. The riser 22 is supported by a tensioning system 24 which maintains the riser 22 within a predetermined range of tensional loads while the drill ship 10 moves relative to the wellhead 23 in response to waves, wind and current. To accommodate this motion of the drill ship 10, the riser 22 is provided with a slip joint 26.

The drilling rig 14 supports and powers a drill string 28 which extends downward through the riser 22 into the well 16. A drill bit 30 is affixed to the lower end of the drill string 28. In the course of drilling operations, a substantially constant flow of drilling fluid is introduced into the well 16 by a drilling fluid handling system 31. A pump 32 forces drilling fluid from a drilling fluid storage tank 34 into a standpipe 36. From the standpipe 36 the drilling fluid enters a swivel 38 and passes into the tubular drill string 28. The drilling fluid travels downward through the drill string 28 and passes into the well 16 through jets in the drill bit 30. The drilling fluid returns upward through the annulus defined by the well 16 and drill string 28 and then passes through the riser 22 into the slip joint 26 from which it passes into a return line 40 and finally is returned to the drilling fluid storage tank 34. This flowpath is indicated by arrows in FIG. 1.

The drilling fluid handling system 31 is provided with a delta flow monitoring system 12 for the purpose of detecting the occurrence of kicks and lost circulation during drilling operations. To establish the magnitude of the delta flow, it is necessary to compare the rate of drilling fluid inflow to the rate of drilling fluid outflow. An inflow flowmeter 42 for monitoring the rate at which drilling fluid is pumped into the drill string 28 is positioned in the flowpath intermediate the drilling fluid tank 34 and the swivel 38. An outflow flowmeter 44 is positioned in the return flowline 40 intermediate the slip joint 26 and the drilling fluid storage tank 34. The flowmeters 42,44 are adapted to generate output signals corresponding to the detected flow rate. Preferably, the flowmeters 42,44 are magnetic flowmeters, such as Flowmeter Model 10D1435 A/U manufactured by Fisher & Porter. The measurements made by such flowmeters are based on the voltage induced across a set of electrodes by the flow of drilling fluid past a strong magnetic field. Such flowmeters are well suited for use in delta flow monitoring systems because they present substantially no restriction to fluid flow, are accurate to within 1% of total flowrate, and are resistant to fouling.

Monitoring the rate at which drilling fluid leaves the well 16 in floating drilling operations is complicated by the contraction and extension of the telescoping slip joint 26. The resulting changes in internal volume of the slip joint 26 introduce cyclical variations in the instantaneous flow rate of drilling fluid leaving the riser 22. The magnitude of these oscillations is dependent on the then-existing sea state. Generally, the larger are the waves, the greater is the vessel heave and the resulting flow oscillation. Under certain conditions, the flow rate contribution due to motion of the slip joint 26 can reach an instantaneous maximum in excess of 12 barrels/minute (1800 liters/minute). This contribution to the overall differential flow rate can mask the detection of fluid transfer between the well 16 and the surrounding formations 20.

To minimize the effect which heave induced variations have on the instantaneous differential flow rate, the output signals of the flowmeters 42, 44 are filtered. In the preferred embodiment of the present invention, this filtering is accomplished by measuring the total flow occurring during a preselected time period, termed the time constant, and dividing this total flow by the time constant. This yields a filtered flow rate which at any given time represents the average flow measured over the duration of the time constant. The greater the time constant, the greater the degree of filtering.

Selection of an appropriate degree of filtering is important in delta flow monitoring. If the degree of filtering is inadequate for existing conditions, the monitoring system 12 will be overly sensitive, yielding false warnings of abnormal well conditions in response to vessel heave, minor changes in the rate at which the drilling fluid is pumped, and drill string motion. False delta flow alarms are very undesirable in that they may cause drilling personnel to ignore subsequent valid alarms. Conversely, if the degree of filtering is too great, the response time of the delta flow monitoring system 12 to actual kicks and lost circulation will become unacceptably long, increasing the chance that before being recognized a well control problem will advance to a stage where it is difficult to control. Because the sea state and other conditions causing fluctuations in the observed delta flow rate continually change with time, it is desirable to continually adjust the degree of filtering to provide optimum accommodation for then-existing conditions.

In the present invention, the degree of filtering applied by the delta flow monitoring system 12 is automatically adjusted to maintain an optimal balance between minimizing false indications of flow problems by filtering out normal changes in the delta flow rate, such as heave induced components of the return flow, and maintaining a swift response to fluid transfer between the well 16 and the surrounding formations 20. In the preferred embodiment, altering the degree of filtering is accomplished by the repeated application of the following empirical algorithm for calculating the time constant:

$$\text{Time Constant} = (T \times F)/(K \times A) \qquad \text{(Equation 1)}$$

Where

T = average period of ship heave measured over the current time constant

F = difference between the greatest and smallest unfiltered output flow rates over the current time constant K = a dimensionless constant A = input alarm level, measured as a differential flow rate Those skilled in the art will recognize other methods for altering the degree of filtering applied in response to changing environmental conditions. For example, a constant time constant could be employed in conjunction with an algorithm for changing the weighting factor given to individual data points within the current time constant period. In such a system, calm seas would cause the more recent data to be given relatively great weight, thereby decreasing the degree of filtering and increasing the sensitivity of the delta flow monitoring system. Conversely, rough seas would cause an increase in the relative weighting given to older data within the time constant period, thereby decreasing the sensitivity of the delta flow monitoring system.

Figure 2:
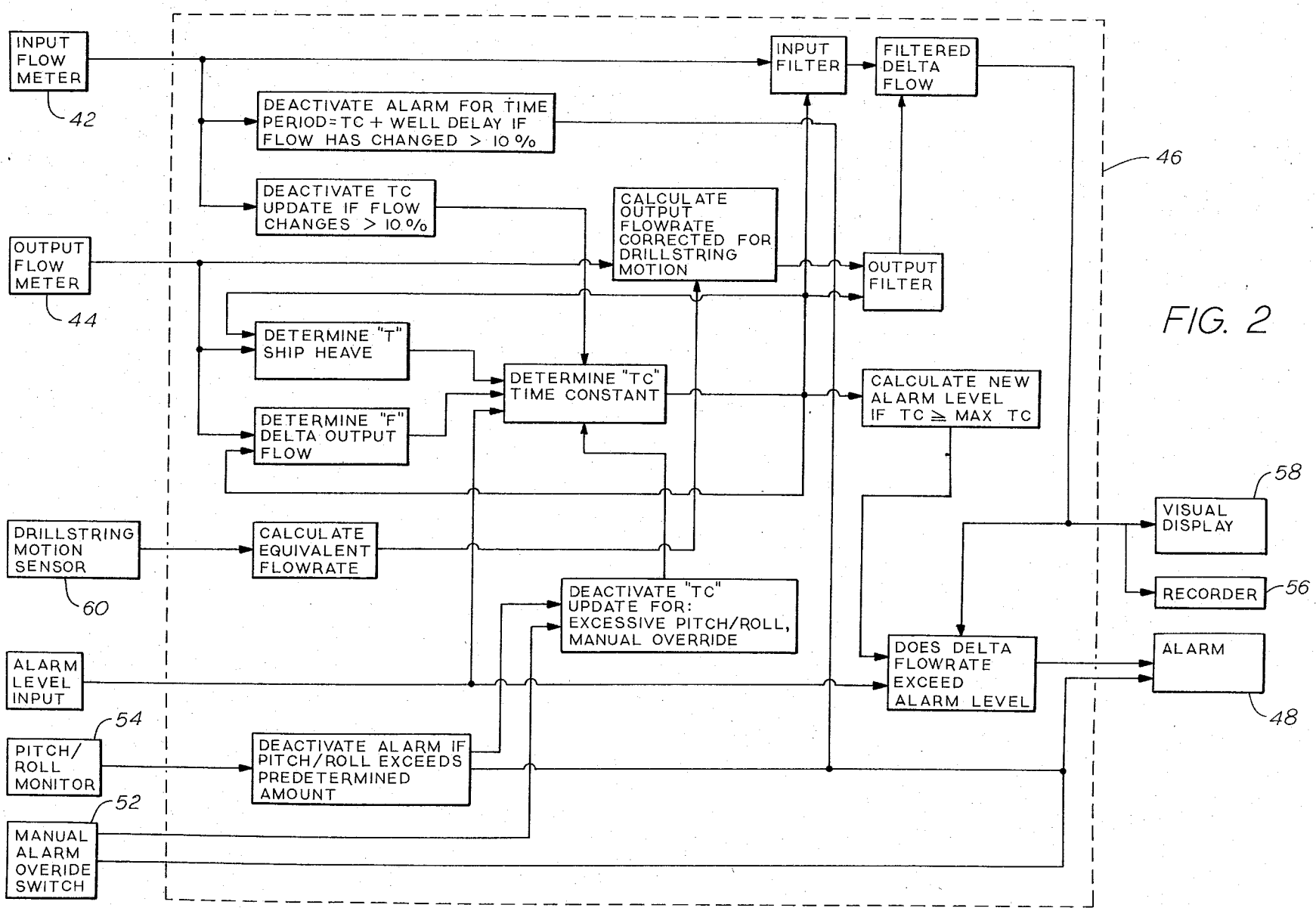
FIG. 2 is a block diagram illustrating the manner in which data developed by the delta flow monitoring system is processed.
Figure 3:
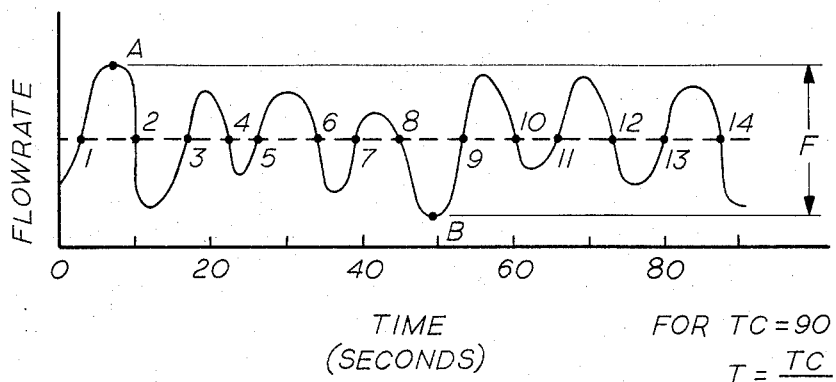
FIG. 3 illustrates the calculation of the valves T and F in equation 1.

Signal filtering and other signal processing in the preferred embodiment of the delta flow monitoring system 12 is performed by a signal processing system 46, schematically illustrated in FIG. 2. Preferably, a suitably programmed digital computer, such as the LSI-11/2 computer manufactured by the Digital Equipment Corporation, is used for this purpose. Determination of the time constant is used in filtering the outputs of the flowmeters 42, 44 is based on oscillations in the output flowrate, calculated in accordance with equation 1. The variables T, the average period of vessel heave, and F, the maximum peak-to-peak amplitude of the output flow oscillation, are determined by an examination of the raw signal from the outflow flowmeter 44 over the duration of the then-current time constant. FIG. 3 illustrates this determination of the values of T and F at a given instant. F is calculated by constantly maintaining a record of the difference between the greatest and smallest output flow rates measured over the duration of the current time constant. T is calculated by maintaining a running record of the number of minima and maxima attained by the output flow rate over the duration of the current time constant and dividing by two. It should be noted that T, the average period of vessel heave, can be determined in many ways other than by monitoring the output flowmeter 44. For example, the value T could be determined by an inertial motion sensor or by monitoring the position of the slip joint 26 as a function of time. The constant K will be unique for each drilling situation. In practice the value of K will be based on experience from prior operations conducted with the specific drilling fluid handling system 31. In most applications the value of K will be set at a level just below that level which would yield an alarm in response to the greatest anticipated heave event.

To calculate the filtered delta flow signal, the signal processing system 46 separately filters the output of the input flow meter 42, and a signal representing the output flow rate as measured by the output flow meter 44 corrected for that component of the output flow resulting from motion of the drill string 28 within the well 16. A common time constant, calculated in accordance with equation 1, is used by the signal processing system 46 in filtering both signals. The correction for motion of the drill string 28 is necessary to prevent the change in fluid capacity of the well 16 resulting from a change in the volume of drill string 28 within the well 16 from being interpreted as a well control problem. The correction is achieved by multiplying the fluid volume equivalent per unit length of drill string by the rate of drill string travel. The rate of drill string travel can be developed by monitoring the motion of the traveling block 50. Further details regarding achieving the correction for drill string travel are set forth in copending U.S. patent application Ser. No. 578,721, filed Apr. 17, 1984 and assigned to the assignee of the present application.

Figure 4:
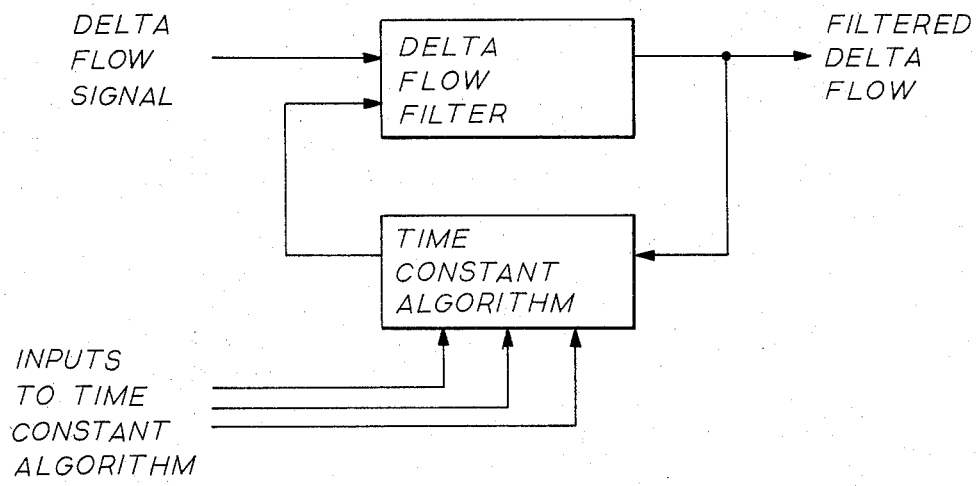
FIG. 4 illustrates an alternate embodiment of the signal filtering means of FIG. 2.

In an alternate embodiment, illustrated in FIG. 4, the signals from the input flowmeter 42, the output flow meter 44 and the flowrate equivalent resulting from drill string motion could be summed prior to filtering. Further, a closed loop control system could be substituted for the open loop control system used in updating the time constant.

The signal processing system 46 continually compares the filtered corrected delta flow rate to an alarm limit. If the alarm limit is exceed, an alarm 48 is activated. The initial alarm limit is an operator input to the signal processing system 46. For typical marine drilling operations a delta flow alarm limit of 25 gallons per minute is appropriate. In addition to providing a warning in response to an excessive corrected delta flow rate, the delta flow monitoring system 12 is provided with a delta flow recorder 56 and visual display 58.

The signal processing system 46 is provided with means for automatically increasing the alarm limit in response to the time constant reaching the preselected upper limit. In the preferred embodiment, this upper time constant limit is 150 seconds. This upper limit would typically be reached only in extreme heave conditions. It is necessary to establish this upper limit because beyond a time constant of about 150 seconds, extending the time constant provides relatively little benefit in filtering out heave induced contributions to the delta flow, while increasing the response time to actual circulation problems. Once the preselected upper limit is reached, the alarm level is increased in accordance with the formula:

$$\text{Updated Alarm Level} = (T \times F)/(L \times TC) \qquad \text{(Equation 2)}$$

Where

TC = the maximum time constant

L = Constant, selected such that for the values of T and F existing at the time that the time constant reached its maximum, the alarm level calculated by Eq 2 equals the input alarm level, A.

The delta flow monitoring system 12 is provided with three alarm overrides. The first of these is a manual alarm override switch 52. This permits the alarm 48 to be manually deactivated while tripping and in other situations which otherwise might yield a false indication of a kick or lost circulation. The alarm becomes active again one time constant following the time the manual override 52 is deactivated.

The second alarm override is automatically activated by a change in the input flow rate. This is necessary because a change in the input flowrate introduces a transient which is not reflected in the output flowrate for a period of time, typically several seconds, known as the well delay. In response to detecting a change in the input flowrate of more than preselected amount, preferably about 10%, the signal processing system 46 deactivates the alarm for a time period equal to the time constant plus the well delay. For most floating drilling systems the well delay is substantially independent of well depth. This is because the primary cause of well delay results from the gravity driven flow in the outflow conduit 40 upstream of the outflow flowmeter 44. In the preferred embodiment the well delay is entered into the signal processing system 46 by the operator. Alternately, this value could be computed by the signal processing system 46 through monitoring the response of the delta flow rate to a step change in the input flow rate.

The third alarm override is activated by the pitch-/roll of the drill ship 10 exceeding a set value. Most drill ship drilling fluid handling systems 31 have long runs of piping upstream of the output flowmeter 44. Typically this piping runs partially full, the flow of fluid through the piping being driven by gravity. A pitch or roll in one direction can cause this piping to drain, causing an apparent flow surge. A pitch or roll in the other direction can temporarily stop fluid flow through the output flowmeter 44. Accordingly, the delta flow monitoring system 12 is provided with a monitor 54 for deactivating the alarm 48 when an excessive pitch/roll angle is reached. The alarm 48 is reactivated one time constant plus one well delay period following the termination of the excessive pitch/roll situation.

As an alternative to an automatic override of the alarm 48 in response to reaching an excessive pitch/roll angle, the signal processing system 46 could be adapted to temporarily apply a preselected higher alarm level in response to reaching a certain pitch/roll angle. The system would return to the original alarm level one time constant plus one well delay period following the end of the excessive pitch/roll event.

In an alternate embodiment of the present invention, a fourth alarm override is provided for deactivating the alarm 48 in response to the equivalent flowrate resulting from drillstring motion reaching a preselected level, for example 50% of the alarm level flowrate. This avoids the need to correct the reading of the output flow meter 44 for the effects of drillstring motion. The alarm would be reactivated one time constant plus one well delay following the time when the equivalent flowrate resulting from drillstring motion has fallen below the level established for deactivation of the alarm 48.

The signal processing means 46 is programmed to permit the time constant to be updated only during those periods when output flow oscillations result predominantly from vessel heave. This is accomplished by suspending any update of the time constant when: the change in borehole fluid capacity due to drill string motion exceeds a set rate, typically 10 gallons per minute; a pitch/roll event of sufficient magnitude to permit the return line 40 to drain occurs; the inflow flowrate changes by more than a preselected amount, typically 10%; or, the manual override 52 is activated. The time constant update function is reactivated one well delay period plus one filter time constant following cessation of the event. Preselected maximum and minimum values are established for the time constant; typically, 150 seconds and 30 seconds, respectively.

The present invention and the preferred modes of practicing it have been described. It is to be understood that the foregoing description is illustrative only and that other means and techniques can be employed without departing from the full scope of the invention as set forth in the appended claims.

What is claimed is:

1. A method for determining the rate of fluid transfer between an offshore well and the formations surrounding the well in the course of drilling the well from a floating drilling rig, said method comprising the steps of:

measuring the rate at which drilling fluid is injected into the well from the floating drilling rig;

measuring the rate at which drilling fluid is returned to the floating drilling rig from the well;

determining the magnitude of the oscillations in the rate at which drilling fluid has been returned to the drilling rig over a preselected period of time;

calculating a filtered differential flow rate representing the difference between the inflow and outflow rates averaged over a time constant, the value of the time constant being a function of the magnitude of the oscillation in the rate at which drilling fluid is returned to the floating rig from the well;

comparing said filtered differental flow rate to an alarm level;

activating an alarm in response to said filtered differential flow rate exceeding said alarm level; and repeating the above steps through the course of the well drilling operations.

2. The method as set forth in claim 1 further including the step of determining the period of the oscillations in the rate at which drilling fluid has been returned to the drilling rig over a preselected period of time and wherein calculation of the differential flow rate includes establishing a time constant which is directly proportional to the product of the period and the magnitude of the oscillation in the rate at which drilling fluid is returned to the drilling rig.

3. The method as set forth in claim 1 further including the step of suspending any recalculation of the time constant for a preselected period of time following any alteration of more than a preselected amount of the rate at which drilling fluid is injected into the well.

4. A system for monitoring the delta flow-rate of drilling fluid in the course of circulating drilling fluid through a well from a drilling rig, comprising:

an inflow flowmeter adapted for establishing a first signal representing the rate at which drilling fluid is injected into the well from the drilling rig;

an outflow flowmeter adapted for establishing a second signal representing the rate at which drilling fluid is returned to the drilling rig from the well; and a signal processing system adapted for receiving said first and second signals and calculating a third signal representing the filtered difference between the first and second signals, the signal processing system being adapted to repeatedly update the degree of filtering applied in calculating said third signal in accordance with a relation serving to increase the degree of filtering in response to an increase in the magnitude of the cyclical variations in the rate at which drilling fluid is returned to the drilling rig and to decrease the degree of filtering in response to a decrease in the magnitude of the cyclical variations in the rate at which drilling fluid is returned to the drilling rig.

5. The monitoring system as set forth claim 4 wherein said signal processing system filters said first and second signals of over a time constant, said signal processing system being adapted to increase the time constant in response to increasing magnitude of cyclical variations in the rate at which drilling fluid is returned to the drilling rig and to decrease the time constant in response to decreasing magnitude of cyclical variations in the rate at which drilling fluid is returned to the drilling rig.

6. The drilling fluid monitoring system as set forth in claim 5, wherein said signal processing system is adapted to calculate a filter time constant having a magnitude which a function of the product $F \times T$, where:

$F$ = the magnitude of the oscillation in the rate at which drilling fluid is returned to the drilling rig, and $T$ = the period of the oscillations in the rate of drilling fluid return.

7. The drilling fluid monitoring system as set forth in claim 6, wherein said signal processing system is adapted to calculate factor F by subtracting the lowest return flow rate occurring within a preselected time period from the highest return flow rate occurring within said preselected time period.

8. The drilling fluid monitoring system as set forth in claim 5, wherein said signal processing system is adapted to continually update said third signal and following each update, to compare said third signal to a preselected alarm limit.

9. The drilling fluid monitoring system as set forth in claim 8, further including means for activating an alarm in response to said third signal reaching said alarm limit.

10. The drilling fluid monitoring system as set forth in claim 8, wherein said signal processing system is adapted to prevent said time constant from increasing beyond a preselected maximum time constant value, said signal processing system being further adapted to increase said alarm limit in response to increasing oscillation magnitude in the rate of drilling fluid return subsequent to said time constant reaching said maximum time constant value.

11. The drilling fluid monitoring as set forth in claim 4 further including means for establishing a fourth signal, the fourth signal representing the rate at which the volume of drill string within the well is changing, said second signal representing the rate at which drilling fluid is returned to the drilling rig, corrected for said fourth signal.

12. A drilling fluid monitoring system for establishing the rate of fluid transfer between an offshore well being drilling from a floating drilling rig and the formations surrounding the well, there being a marine riser extending from the well to the drilling rig for returning drilling fluid from said well to said drilling rig, said marine riser being adapted to accommodate vessel heave, said fluid monitoring system comprising:

an inflow flowmeter adapted for establishing a first signal representing the rate at which drilling fluid is injected into the well;

an outflow flowmeter adapted for establishing a second signal representing the rate at which drilling fluid is returned to the drilling rig from the well; and, a signal processing system adapted for receiving said first and second signals and calculating a third signal representing the filtered difference between the first and second signal, the time constant of the filtering applied by said signal processing system being variable over a range of values in accordance with a control algorithm relating the magnitude of the time constant to the magnitude of oscillations in the output flow.

13. The drilling fluid monitoring system as set forth in claim 12, wherein said signal processing system is adapted to independently filter said first and second signals and then calculate the difference between said filtered second signal and said filtered first signal to yield said third signal.

14. The drilling fluid monitoring system as set forth in claim 12, wherein said signal processing system is adapted to calculate the difference between said first and second signals, and to filter this difference over said calculated time constant to yield said third signal.

15. The drilling fluid monitoring system as set forth in claim 12, wherein said signal processing system is adapted to calculate a filter time constant which is directly proportional to the magnitude of the oscillation in the rate at which drilling fluid is returned to the drilling rig.

16. The drilling fluid monitoring system as set forth in claim 12, wherein said signal processing system is adapted to calculate a filter time constant which is directly proportional to the product $F \times T$ where:

$F$ = the magnitude of the oscillation in the rate at which drilling fluid is returned to the drilling rig, and $T$ = the period of the oscillations in the rate of drilling fluid return.

17. The drilling fluid monitoring system as set forth in claim 16, wherein said signal processing system is adapted to calculate factor F by subtracting the lowest return flow rate occurring within a preselected time period from the highest return flow rate occurring within said preselected time period.

18. The drilling fluid monitoring system as set forth in claim 17, wherein said signal processing system is adapted to continually update said third signal and following each update, to compare said third signal to an alarm limit.

19. The drilling fluid monitoring system as set forth in claim 12 wherein said signal processing system is adapted to continually update said third signal and to repeatedly compare said third signal to an alarm limit.

20. The drilling fluid monitoring system as set forth in claim 19 further including an alarm and means for activating said alarm in response to said third signal exceeding said alarm limit.

21. The drilling fluid monitoring system as set forth in claim 20 further including means for deactivating said alarm and suspending updates of said time constant for a preselected period of time in response to said first signal changing by more than a preselected amount.

22. The drilling fluid monitoring system as set forth in claim 12 wherein said signal processing system is adapted to prevent the value of said time constant from increasing beyond a preselected maximum value and is adapted to increase said alarm limit in response to increase in the magnitude of oscillation of said third signal during those periods when said time constant is at its maximum value.

* * * * *